US010758941B2

(12) United States Patent
Goosen

(10) Patent No.: US 10,758,941 B2
(45) Date of Patent: Sep. 1, 2020

(54) BUCKET MOUNTED SIFTER ASSEMBLY

(71) Applicant: Vernon Goosen, Spring Lake, MI (US)

(72) Inventor: Vernon Goosen, Spring Lake, MI (US)

( * ) Notice: Subject to any disclaimer, the term of this patent is extended or adjusted under 35 U.S.C. 154(b) by 85 days.

(21) Appl. No.: 16/183,876

(22) Filed: Nov. 8, 2018

(65) Prior Publication Data

US 2020/0147645 A1 May 14, 2020

(51) Int. Cl.
*B07B 1/02* (2006.01)
*B07B 1/46* (2006.01)

(52) U.S. Cl.
CPC ..... *B07B 1/02* (2013.01); *B07B 1/4663* (2013.01)

(58) Field of Classification Search
CPC ..... B07B 1/4663; B07B 1/02; B07B 1/06
USPC ..... 209/311, 319, 402, 403
See application file for complete search history.

(56) References Cited

U.S. PATENT DOCUMENTS 874,109 A * 12/1907 McLoney ..... 209/405
1,030,673 A * 6/1912 McIlvaine ..... B07B 1/46 209/405
4,380,494 A * 4/1983 Wilson ..... B07B 1/46 209/319
4,381,669 A * 5/1983 Peters ..... B07B 1/06 209/237
4,472,269 A 9/1984 Swick
5,423,430 A 6/1995 Zaffiro
5,622,266 A 4/1997 Curtis
D398,663 S 9/1998 Freelander
6,227,401 B1 * 5/2001 Rowland ..... B65D 21/0219 206/508
7,114,459 B2 * 10/2006 Schmidt ..... A01K 1/0114 119/161
8,113,355 B1 2/2012 Peterson
9,095,881 B2 * 8/2015 Rieck ..... B07B 1/28
9,132,452 B2 * 9/2015 Trivette ..... B03B 5/02
D744,302 S 12/2015 Westgard
9,352,359 B2 5/2016 Lamjav
D786,630 S * 5/2017 Walsh ..... D7/667
10,010,910 B1 * 7/2018 Stover ..... B07B 1/02
2014/0048456 A1 * 2/2014 Adams, Sr. ..... B07B 1/06 209/325
2016/0108555 A1 * 4/2016 Rosado ..... B07B 1/02 209/409

FOREIGN PATENT DOCUMENTS

WO WO9832544 7/1998

* cited by examiner

*Primary Examiner* — Patrick H Mackey

(57) ABSTRACT

A bucket mounted sifter assembly includes a ring that is positionable around a top end of a bucket. A pair of handles is each coupled to the ring for gripping. A first screen is positioned within the ring, and rocks and particulates can be positioned on the first screen. The first screen has openings therein of approximately 0.5 inches in size to facilitate the particulates to fall therethrough while inhibiting the rocks from passing therethrough for sifting the rocks. A second screen is positionable on the first screen and the second screen has openings therein of approximately 0.25 inches in size. Thus, the second screen reduces the size of material that can pass through the second and first screens. A fastener is extendable through the first and second screens when the second screen is positioned on the first screen for releasably coupling the second screen to the first screen.

4 Claims, 5 Drawing Sheets

BUCKET MOUNTED SIFTER ASSEMBLY

CROSS-REFERENCE TO RELATED APPLICATIONS

Statement Regarding Federally Sponsored Research or Development

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to sifter devices and more particularly pertains to a new sifter device for removing unwanted debris from landscaping rock.

BRIEF SUMMARY OF THE INVENTION

An embodiment of the disclosure meets the needs presented above by generally comprising a ring that is positionable around a top end of a bucket. A pair of handles is each coupled to the ring for gripping. A first screen is positioned within the ring, and rocks and particulates can be positioned on the first screen. The first screen has openings therein of approximately 0.5 inches in size to facilitate the particulates to fall therethrough while inhibiting the rocks from passing therethrough for sifting the rocks. A second screen is positionable on the first screen and the second screen has openings therein of approximately 0.25 inches in size. Thus, the second screen reduces the size of material that can pass through the second and first screens. A fastener is extendable through the first and second screens when the second screen is positioned on the first screen for releasably coupling the second screen to the first screen.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
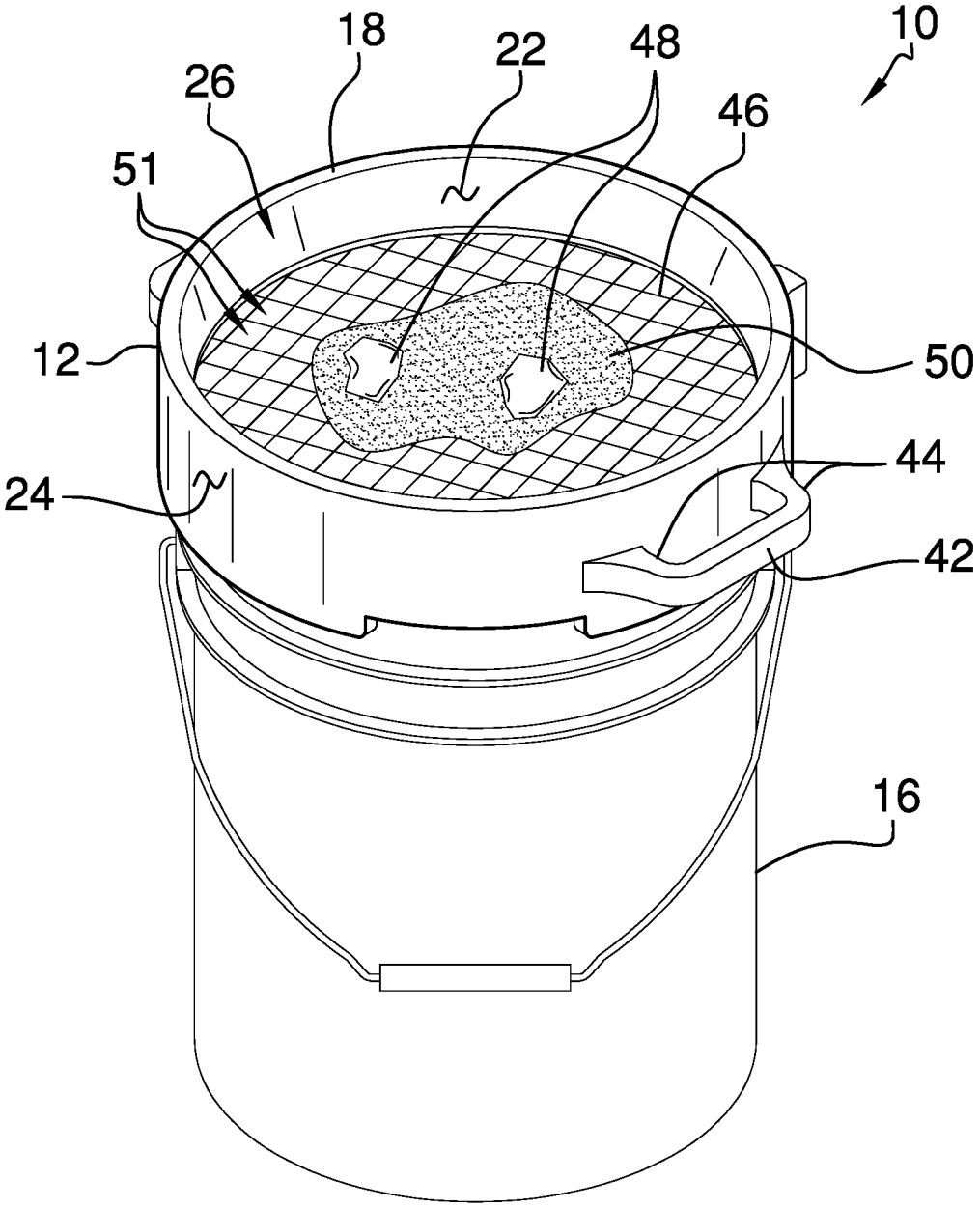
FIG. 1 is a top perspective view of a bucket mounted sifter assembly according to an embodiment of the disclosure.
Figure 2:
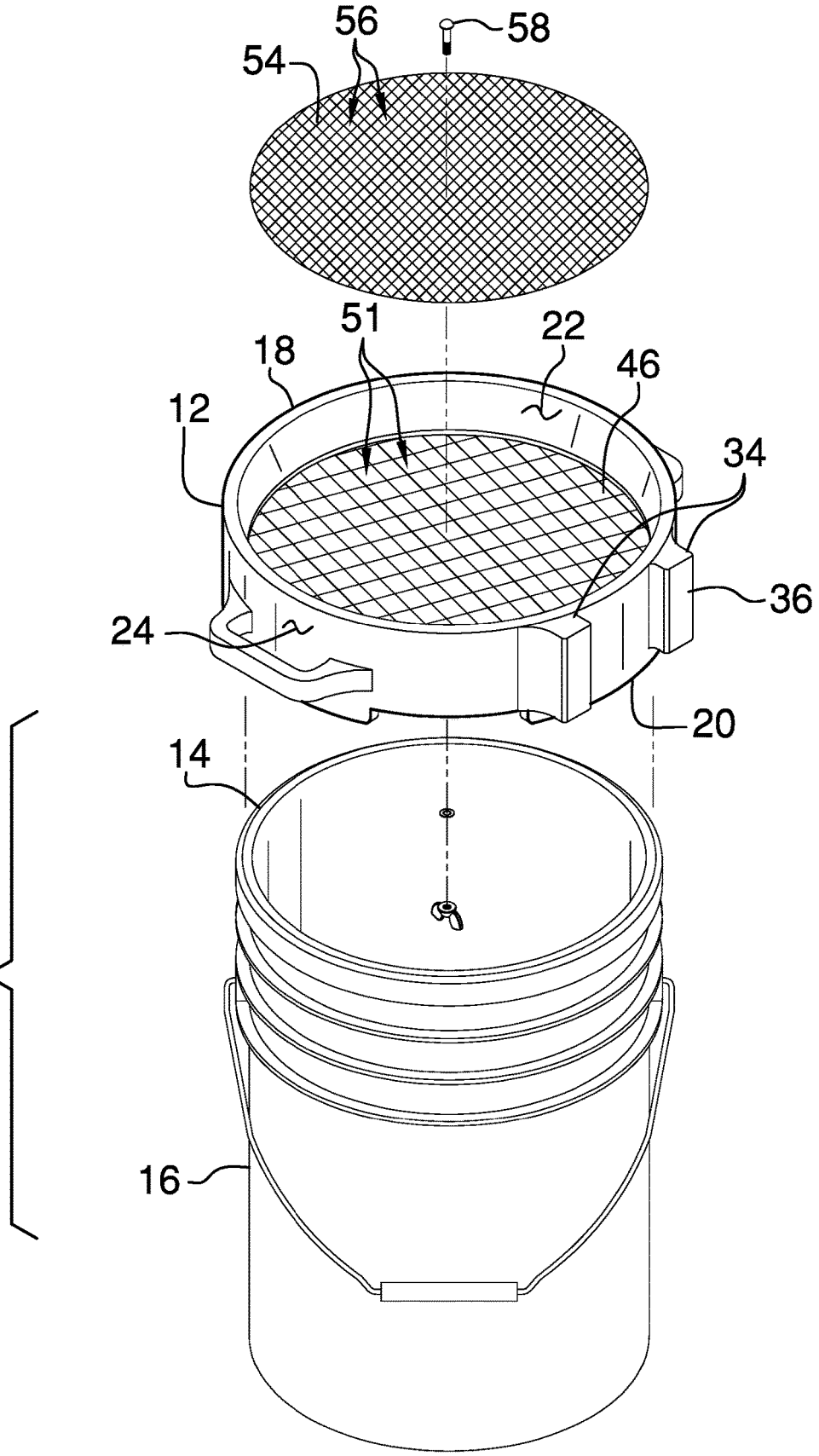
FIG. 2 is an exploded perspective view of an embodiment of the disclosure.
Figure 3:
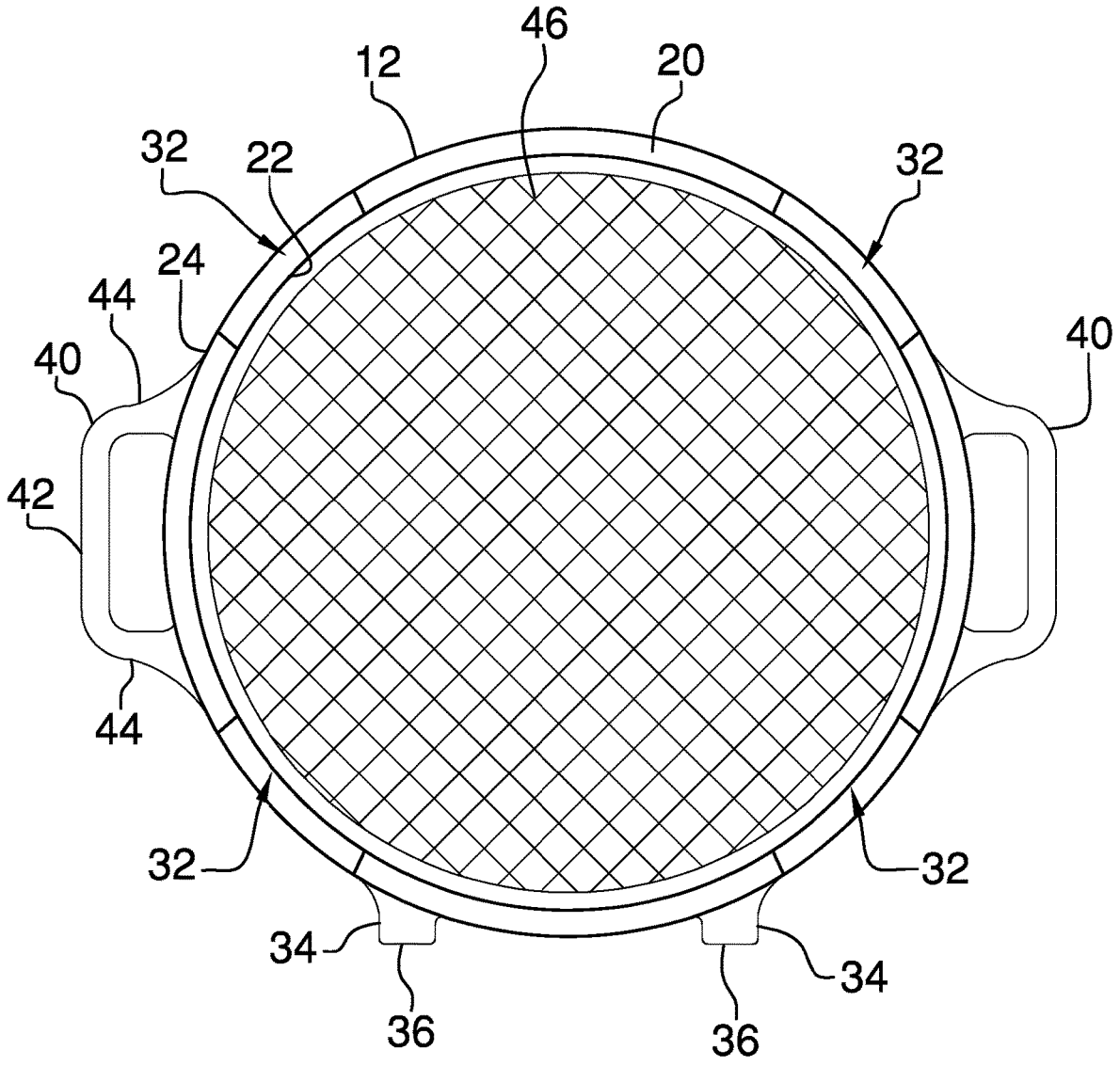
FIG. 3 is a bottom view of a ring of an embodiment of the disclosure.
Figure 4:
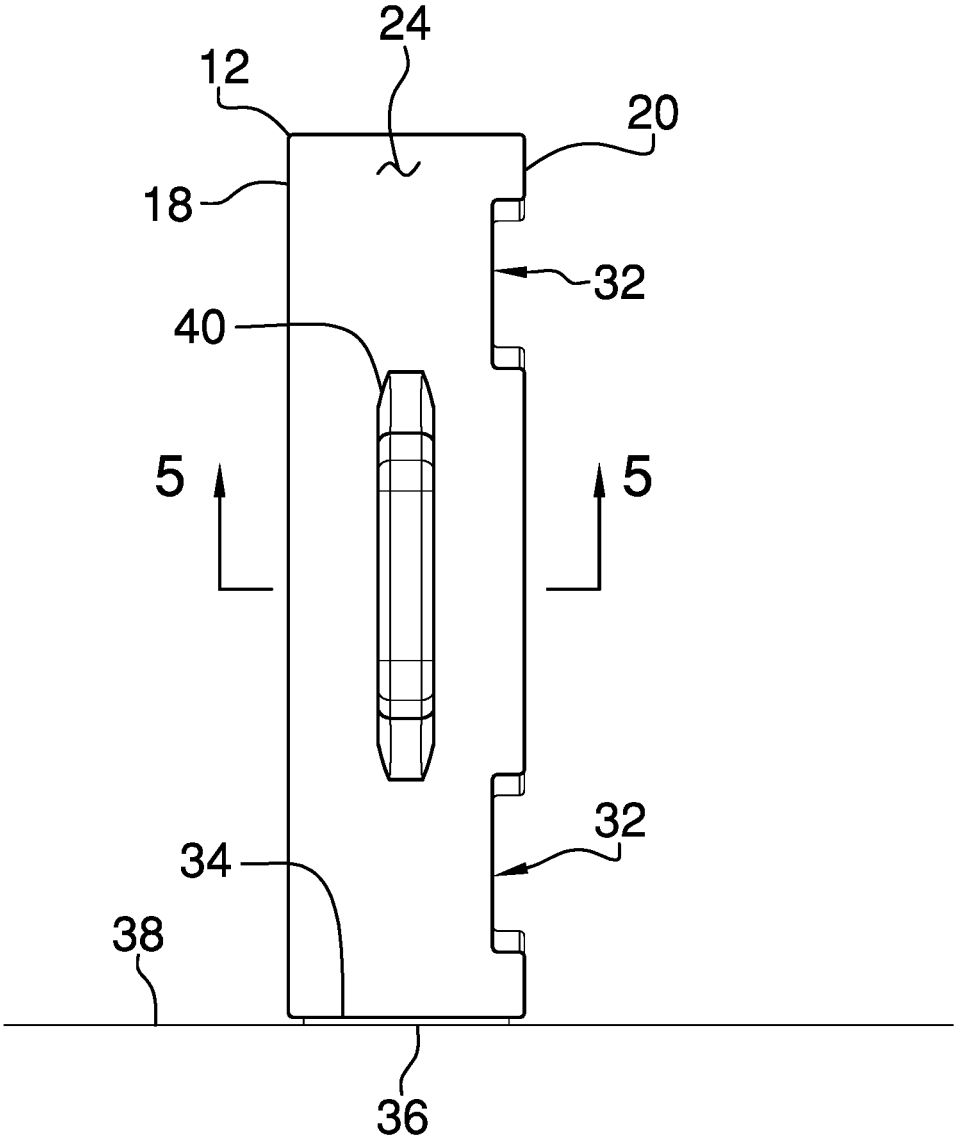
FIG. 4 is a front view of ring an embodiment of the disclosure being stood upon a support surface.
Figure 5:
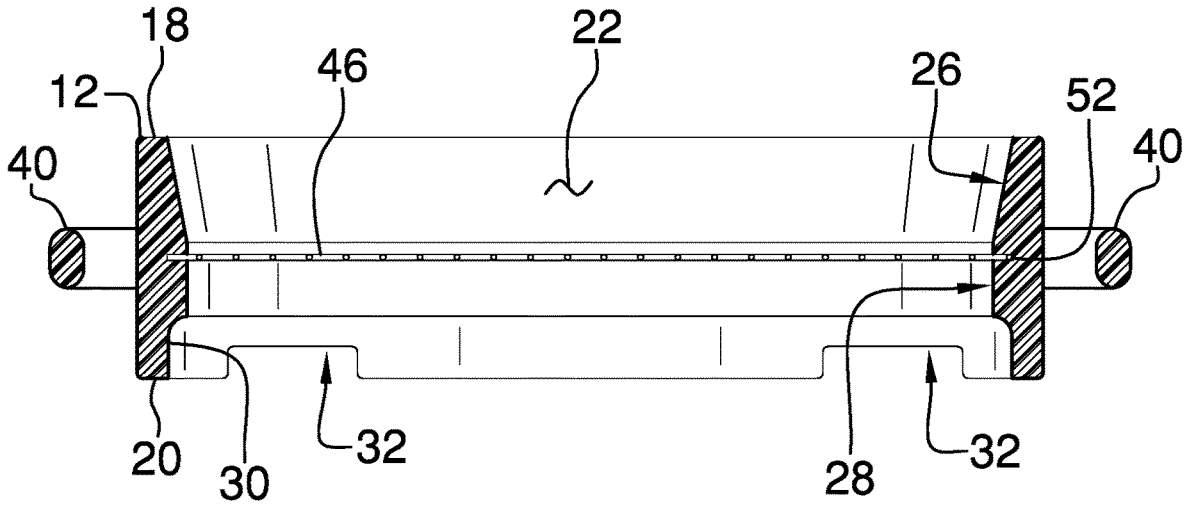
FIG. 5 is a cross sectional view taken along line 5-5 of FIG. 4 of an embodiment of the disclosure.

With reference now to the drawings, and in particular to FIGS. 1 through 5 thereof, a new sifter device embodying the principles and concepts of an embodiment of the disclosure and generally designated by the reference numeral 10 will be described.

As best illustrated in FIGS. 1 through 5, the bucket mounted sifter assembly 10 generally comprises a ring 12 that is positionable around a top end 14 of a bucket 16. Moreover, the ring 12 has an inside diameter of approximately 35.0 cm thereby facilitating the ring 12 to fit around a 5.0 gallon bucket. The ring 12 has a top edge 18, a bottom edge 20, an inwardly facing surface 22 and an outwardly facing surface 24, and each of the inwardly 22 and outwardly 24 facing surfaces is continuously co-arcuate. The inwardly facing surface 22 has an angled portion 26 and a vertical portion 28; the angled portion 26 angles toward a center of the ring 12 between the top edge 18 and the vertical portion 28. Moreover, the vertical portion 28 lies on a plane that is oriented perpendicular with respect to the top 18 and bottom 20 edges.

The vertical portion 28 has an inset 30 extending upwardly from the bottom edge 20 toward the angled portion 26. The inset 30 receives a top end 14 of the 5.0 gallon bucket 16 thereby facilitating the ring 12 to rest on the top end 14. The bottom edge 20 has a plurality of cutouts 32 each extending upwardly toward the top edge 18, and the cutouts 32 are spaced apart from each other and are distributed around the bottom edge 20. Each of the cutouts 32 accommodates structural features on the bucket 16 that would otherwise inhibit the ring 12 from sitting on the top end 14. The outwardly facing surface 24 has a pair of prominences 34 each extending outwardly therefrom and each of the prominences 34 has a distal end 36 with respect to the outwardly facing surface 24. The distal end 36 of each of the prominences 34 is flattened to facilitate each of prominences 34 to rest on a support surface 38 for standing the ring 12 on the support surface.

A pair of handles 40 is each coupled to the ring 12 for gripping. Each of the handles 40 has a central member 42 extending between a pair of outward members 44. Moreover, each of the outward members 44 of each of the handles 40 is coupled to the outwardly facing surface 24 of the ring 12 having the central member 42 of each of the handles 40 being spaced from the outwardly facing surface 24. The handles 40 are positioned on opposite sides of the ring 12 with respect to each other.

A first screen 46 is positioned within the ring 12, and rocks 48 and particulates 50 can be positioned on the first screen 46 for sifting. The first screen 46 has openings 51 therein of approximately 0.5 inches in size to facilitate the particulates 50 to fall therethrough while inhibiting the rocks 48 from passing therethrough. In this way the particulates 50 can be sifted from the rocks 48. The rocks 48 may be landscaping rocks that have been positioned alongside a sidewalk or the like. The particulates 50 may be sand, pieces of debris or any other collection of unwanted objects that have been introduced to the rocks 48. The first screen 46 has an outer edge 52 and the outer edge 52 is recessed into the vertical portion 28 of the inwardly facing surface 22 of the ring 12. Moreover, the outer edge is coextensive with the vertical portion 28 of the inwardly facing surface 22 and the first screen 46 is horizontally oriented when the ring 12 is positioned on the bucket 16.

A second screen 54 is provided and the second screen 54 is positionable on top of the first screen 46. The second screen 54 has openings 56 therein of approximately 0.25 inches in size for reducing the size of material that can pass through the second 54 and first 46 screens. Thus, the second screen 54 can be positioned on the first screen 46 for sifting pea rock or other rocks 48 or material of a similar size. A fastener 58 is extendable through the first 46 and second 54 screens when the second screen 54 is positioned on the first screen 46 for releasably coupling the second screen 54 to the first screen 46. The fastener 58 may include a bolt, a nut and a washer or any other type of releasable fastener.

In use, the ring 12 is positioned on the top end 14 of the bucket 16 and the rocks 48 and particulates 50 are dumped onto the first screen 46. The bucket 16 and ring 12 can be agitated to assist the particulates 50 to fall through the first screen 46 for collecting in the bucket 16. The rocks 48 that remain on the first screen 46 can be dumped back to their original location. In this way debris, sand or other unwanted material can be removed from landscaping rocks or other similar collection of ornamental rocks. Additionally, the second screen 54 can be positioned on top of the first screen 46 for reducing the size of rocks 48 that are retained during sifting. The fastener 58 can be extended through the first 46 and second 54 screens to retain the second screen 54 in the ring 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A bucket mounted sifter assembly being configured to be positioned over a bucket for sifting particulates from rock, said assembly comprising:

a ring being positionable around a top end of a bucket, said ring having an inside diameter of 35.0 cm wherein said ring is configured to fit around a 5.0 gallon bucket;

a pair of handles, each of said handles being coupled to said ring for gripping;

a first screen being positioned within said ring wherein said first screen is configured to have rocks and particulates positioned thereon, said first screen having openings therein of 0.5 inches in size wherein said first screen is configured to facilitate the particulates to fall therethrough while inhibiting the rocks from passing therethrough for sifting the rocks;

a second screen being positionable on said first screen, said second screen having openings therein of 0.25 inches in size wherein said second screen is configured to reduce a size of material that can pass through said second and first screens;

a fastener being removably extendable through said first and second screens when said second screen is positioned on said first screen for releasably coupling said second screen to said first screen;

said ring having a top edge, a bottom edge, an inwardly facing surface and an outwardly facing surface, each of said inwardly and outwardly facing surfaces being continuously co-arcuate, said inwardly facing surface having an angled portion and a vertical portion, said angled portion angling toward a center of said ring between said top edge and said vertical portion, said vertical portion lying on a plane being oriented perpendicular with respect to said top and bottom edges;

said vertical portion having an inset extending upwardly from said bottom edge toward said angled portion wherein said inset is configured to receive a top end of the 5.0 gallon bucket thereby facilitating said ring to rest on the top end;

said bottom edge having a plurality of cutouts each extending upwardly toward said top edge, said cutouts being spaced apart from each other and being distributed around said bottom edge; and said outwardly facing surface having a pair of prominences each extending outwardly therefrom, each of said prominences having a distal end with respect to said outwardly facing surface, said distal end of each of said prominences being flattened wherein said distal end of each of prominences is configured to rest on a support surface for standing said ring on the support surface.

2. The assembly according to claim 1, wherein each of said handles has a central member extending between a pair of outward members, each of said outward members of each of said handles being coupled to said outwardly facing surface of said ring having said central member of each of said handles being spaced from said outwardly facing surface, said pair of handles being positioned on opposite sides of said ring with respect to each other.

3. The assembly according to claim 1, wherein said first screen has an outer edge, said outer edge being recessed into said vertical portion of said inwardly facing surface of said ring, said outer edge being coextensive with said vertical portion of said inwardly facing surface.

4. A bucket mounted sifter assembly being configured to be positioned over a bucket for sifting particulates from rock, said assembly comprising:

a ring being positionable around a top end of a bucket, said ring having an inside diameter of 35.0 cm wherein said ring is configured to fit around a 5.0 gallon bucket, said ring having a top edge, a bottom edge, an inwardly facing surface and an outwardly facing surface, each of said inwardly and outwardly facing surfaces being continuously co-arcuate, said inwardly facing surface having an angled portion and a vertical portion, said angled portion angling toward a center of said ring between said top edge and said vertical portion, said vertical portion lying on a plane being oriented perpendicular with respect to said top and bottom edges, said vertical portion having an inset extending upwardly from said bottom edge toward said angled portion wherein said inset is configured to receive a top end of the 5.0 gallon bucket thereby facilitating said ring to rest on the top end, said bottom edge having a plurality of cutouts each extending upwardly toward said top edge, said cutouts being spaced apart from each other and being distributed around said bottom edge, said outwardly facing surface having a pair of prominences each extending outwardly therefrom, each of said prominences having a distal end with respect to said outwardly facing surface, said distal end of each of said prominences being flattened wherein said distal end of each of prominences is configured to rest on a support surface for standing said ring on the support surface;

a pair of handles, each of said handles being coupled to said ring for gripping, each of said handles having a central member extending between a pair of outward members, each of said outward members of each of said handles being coupled to said outwardly facing surface of said ring having said central member of each of said handles being spaced from said outwardly facing surface, said pair of handles being positioned on opposite sides of said ring with respect to each other;

a first screen being positioned within said ring wherein said first screen is configured to have rocks and particulates positioned thereon, said first screen having openings therein of 0.5 inches in size wherein said first screen is configured to facilitate the particulates to fall therethrough while inhibiting the rocks from passing therethrough for sifting the rocks, said first screen having an outer edge, said outer edge being recessed into said vertical portion of said inwardly facing surface of said ring, said outer edge being coextensive with said vertical portion of said inwardly facing surface;

a second screen being positionable on said first screen, said second screen having openings therein of 0.25 inches in size wherein said second screen is configured to reduce a size of material that can pass through said second and first screens; and a fastener being removably extendable through said first and second screens when said second screen is positioned on said first screen for releasably coupling said second screen to said first screen.

* * * * *